US006087738A

United States Patent [19]

Hammond

[11] Patent Number: 6,087,738

[45] Date of Patent: Jul. 11, 2000

[54] VARIABLE OUTPUT THREE-PHASE TRANSFORMER

[75] Inventor: Peter W. Hammond, Westmoreland County, Pa.

[73] Assignee: Robicon Corporation, New Kensington, Pa.

[21] Appl. No.: 09/137,016

[22] Filed: Aug. 20, 1998

[51] Int. Cl.[7] ..... H01F 17/02

[52] U.S. Cl. ..... 307/17; 336/5; 336/10

[58] Field of Search ..... 336/10, 5, 12; 307/17

[56] References Cited

U.S. PATENT DOCUMENTS

| | | |
|---|---|---|
| 3,609,507 | 9/1971 | Beck . |
| 4,039,925 | 8/1977 | Fletcher et al. . |
| 4,142,136 | 2/1979 | Witter . |
| 4,150,425 | 4/1979 | Nagano et al. . |
| 4,201,938 | 5/1980 | Neumann . |
| 4,301,489 | 11/1981 | Stich . |
| 4,319,177 | 3/1982 | Kawada et al. . |
| 4,426,610 | 1/1984 | Kawada et al. . |
| 4,426,611 | 1/1984 | Espelage et al. . |
| 4,434,393 | 2/1984 | Kobari et al. . |
| 4,634,951 | 1/1987 | Kampf et al. . |
| 4,698,738 | 10/1987 | Miller et al. . |
| 4,843,296 | 6/1989 | Tanaka . |
| 4,928,052 | 5/1990 | Fujioka et al. . |
| 4,943,890 | 7/1990 | Schaltenbrand et al. . |
| 5,003,242 | 3/1991 | Liber . |
| 5,005,115 | 4/1991 | Schauder . |
| 5,008,797 | 4/1991 | Patel et al. . |
| 5,047,913 | 9/1991 | DeDoncker et al. . |
| 5,073,848 | 12/1991 | Steigerwald et al. . |
| 5,179,510 | 1/1993 | Tokiwa et al. . |
| 5,319,536 | 6/1994 | Malik . |
| 5,574,418 | 11/1996 | Matsummura et al. ..... 336/5 |
| 5,594,636 | 1/1997 | Schauder . |
| 5,619,407 | 4/1997 | Hammond . |
| 5,625,545 | 4/1997 | Hammond . |
| 5,638,263 | 6/1997 | Opal et al. . |
| 5,646,498 | 7/1997 | Lipo et al. . |
| 5,708,576 | 1/1998 | Jones et al. . |
| 5,729,113 | 3/1998 | Jansen et al. . |
| 5,764,499 | 6/1998 | Klug et al. . |
| 5,808,882 | 9/1998 | Mochikawa . |

FOREIGN PATENT DOCUMENTS

| | | |
|---|---|---|
| 42-2703 | 1/1970 | Japan . |
| 6141559 | 5/1994 | Japan . |
| 8-317693 | 11/1996 | Japan . |
| 10-162945 | 6/1998 | Japan . |
| 10-172746 | 6/1998 | Japan . |

OTHER PUBLICATIONS

ABB Industrie AG Product Brochure titled ACS 1000 Drive Description, 1997 Month Not Provided by Applicant.

ABB Industrie AG Product Brochure The ACS 1000 is performance simplified, 1997 Month Not Provided by Applicant.

(List continued on next page.)

*Primary Examiner*—Fritz Fleming
*Assistant Examiner*—Robert L. DeBeradinis
*Attorney, Agent, or Firm*—Buchanan Ingersoll, P.C.

[57] ABSTRACT

A three-phase transformer having a variable output utilizes an auxiliary winding to minimize the number of switches or taps required to provide a plurality of output voltages. At least two output windings or coils each have a plurality of taps corresponding to varying percentages of output voltages. Although each output winding has at least one tap at the same voltage level, one of the output windings has an additional tap corresponding to a different output voltage level. The auxiliary winding, which preferably has a number of coil turns equal to that corresponding to the spacing between the different voltage levels on the output winding, permits one output winding to be set at a different voltage level than the other output winding. The auxiliary winding includes a pair of terminals which are alternately operable to balance the level and phase of the overall output voltage of the three-phase transformer. The device can be used as a motor starter having more variable, and hence more precise control for motor starting voltage.

11 Claims, 9 Drawing Sheets

OTHER PUBLICATIONS

"A New 24–Pulse Diode Rectifier System for AC Motor Drives Provides Clean Power Utility Interface with Low kVA Components," Lee et al., IEEE, 1996, pp. 1024–1031 Month Not Provided by Appl.

"Current Stiff Converter Topologies with Resonant Snubbers," Filho et al., Research Report No. 97–22, University of Wisconsin–Madison College of Engineering, 1997 Month Not Provided by Applicant.

"Development of a Regenerative Three–Phase Multicell Inverter," Rodriguez et al. Date Not Provided by Applicant.

"Displacement Angle Control of Matrix Converter," Oyama et al., IEEE, 1997 Month Not Provided by Applicant.

"Dynamic Braking of Induction Motors," C. Grantham, *Journal of Electrical and Electronics Engineering,* Australia IE Aus. & IREE Aust. vol. 6, No. 3, Sep. 1986.

"Dynamic Performance and Control of a Static Var Generator Cascade Multilevel Inverters," Peng et al., *IEEE Transactions on Industry Applications,* vol. 33, No. 3, May/Jun. 1997, pp. 748–755.

"Electrodynamical Phenomenon in a System Voltage Inverter–Induction Machine by the Loss of D.C. Supply Voltage," Zdenek et al., *ACTA Technica CSAV,* Oct., 1979, pp. 431–447.

"High Performance Current Control Techniques for Applications to Multilevel High–Power Voltage Source Inverters," Mario Marcheson, *IEEE Trransactions on Power Electronics,* vol. 7, No. 1, Jan., 1992.

"Modeling, Analysis and Simulation of Multilevel Converters with Regenerative Cells," Rodriguez et al pp. 829–834 Date Not Provided by Applicant.

"Resonant Snubbers with Auxiliary Switches," William McMurray, IEEE/IAS Ann. Meet. Conf. Rec., 1989 Month Not Provided by Applicant.

"Synthetic Loading of Machines," Spooner et al., Electrical Energy Conference, 1986, Brisbane Oct., 20–22, 1986, pp. 194–297.

Use of a LC Filter to Achieve a Motorfriendly Performance of the PWM Voltage Source Inventor, Steinke et al., IEEE, 1997 Month Not Provided by Applicant.

Utilisation de Transistors A Fort Courant et Tension Elevee, Bingen et al., University of Brussels Date Not Provided by Appl.

Voltage Stress on Induction Motors in Medium–Voltage Drives, Wu et al., *IEEE Transactions on Power Electronics,* vol. 12, No. 2, Mar. 1997.

"High Voltage Multilevel Converter with Regeneration Capability," Rodriguez et al. Date Not Provided by Applicant.

ALTERNATE WAYS TO IMPLEMENT AN AC SWITCH WITH SEMICONDUCTOR DEVICES

VARIABLE OUTPUT THREE-PHASE TRANSFORMER

BACKGROUND OF THE INVENTION

1. Field of the Invention

The invention relates to a three-phase transformer, and more particularly to an improved three-phase transformer with windings which provide discrete voltage levels form a plurality of taps. Such transformer can be used in many applications such as a reduced voltage motor starter.

2. Description of the Prior Art

There are many applications which require a means to adjust the amplitude of a balanced three-phase AC voltage source. A balanced three-phase source is one which has available three equal voltages which are 120° out of phase with each other. Two examples of applications are a regulator for utility voltage, and a reduced-voltage starter for AC induction motors. FIG. 1 shows an example of a previous approach for a reduced-voltage starter in which a star-connected three-phase transformer winding is provided with a plurality of taps on each phase. For large motors it is desirable to employ reduced-voltage starting due to starting current restrictions. Although FIG. 1 shows the case of four taps per phase, any number is possible. A common method of applying reduced-voltage starting to an AC induction motor is through such an autotransformer. After the input terminals R, S, and T of the transformer have been energized, the taps are connected by closing the appropriate switches to gradually increase throughput voltage, for example 50%, to the final AC induction motor operating voltage, which may be 100% of the transformer output. The degree of control in the motor operation is directly related to the number of taps; the more taps and switches, the more precise the transformer output voltage control. FIG. 1 shows the transformer winding configured as an autotransformer, but it could also be configured as a conventional isolation transformer. The autotransformer shown consists of a single coil per phase linked by a magnetic circuit. Taps are provided such that, with input voltage being applied to one set of taps, output voltage may be taken from any other set of taps. The fixed input voltage terminals are labeled R, S, and T, while the adjustable output terminals are labeled U, V, and W.

For each phase in FIG. 1, a set of switches is provided to allow the corresponding output terminal to be connected to any one of the corresponding taps. While conventional switches are shown in FIG. 1, any type of switch can be utilized provided it is capable of blocking voltage of either polarity when open, and capable of conducting current of either polarity when closed. FIG. 2 shows alternative switch types typically implemented with semiconductors.

For the case of four taps per phase shown in FIG. 1, there are a total of twelve switches (SWU1–SWU4, SWV1–SWV4 and SWW1–SWW4). To avoid short-circuiting the winding, only one switch can be closed in any phase at any time. If the output voltage is to remain balanced, the same switch must be closed in each phase. For example, if switch SWU2 is closed then switches SWV2 and SWW2 must also be closed. Thus even though twelve switches are present, the circuit of FIG. 1 can provide only four distinct levels of balanced output voltage to terminals U-V-W.

FIG. 3 shows another previous approach, which improves on FIG. 1 by providing the same number of output levels with fewer switches. In FIG. 3 the transformer winding is connected in a mesh instead of a star configuration. Also the winding for one phase is omitted. This configuration is known in the art as an open-delta connection. The remaining two windings must support line-to-line voltage, which is 73% higher than the line-to-neutral voltage supported by the three windings of FIG. 1. It is also necessary to reverse the coupling polarity of one of the remaining windings as compared to FIG. 1, as shown by the polarity dots, in order to maintain equal flux in all paths of the magnetic circuit. The output for the phase with the missing winding is connected directly to the corresponding input for the autotransformer case. In FIG. 3 the winding for output terminal V is missing, and output terminal V is connected directly to input terminal S. The approach of FIG. 3 requires only eight switches (eliminating switches SWV1–SWV4) to provide four distinct levels of output voltage. However, this approach is still constrained by the need for matching switches to be closed in each remaining phase.

The large number of switches or connections needed to obtain a small number of levels can discourage the use of either FIG. 1 or 3. For some transformer applications, such as reduced-voltage starters or regulation of utility voltage, it is often desirable to have more levels available to give more precise control.

What is needed then is a methodology whereby the output voltage levels of a transformer or the like can be increased to allow more precise control without inordinately adding to its complexity and cost.

It is therefore an object of the present invention to improve the adjustability of transformer output voltages while minimizing the number of switches or connections required.

It is a further object of the present invention to decrease the number of transformer taps needed to achieve a desired degree of adjustability.

It is another object of the present invention to avoid the constraint that matching taps must be connected in each phase.

SUMMARY OF THE INVENTION

The above objects are attained by the present invention, according to which, briefly stated an improved three-phase AC transformer tap connection is provided wherein alternative switch closing arrangements are permitted by including auxiliary windings and an alternative switching means for an output voltage terminal. The output voltage adjustment switch permits a phase angle adjustment to allow unmatched switches to be closed. In this manner, smaller increments of output voltage are provided to allow for more precise control.

BRIEF DESCRIPTION OF THE DRAWINGS

Various other objects, features and advantages of the invention will become more apparent by reading the following detailed description in conjunction with the drawings, which are shown by way of example only, wherein.

DETAILED DESCRIPTION OF THE PREFERRED EMBODIMENTS

Figure 3:
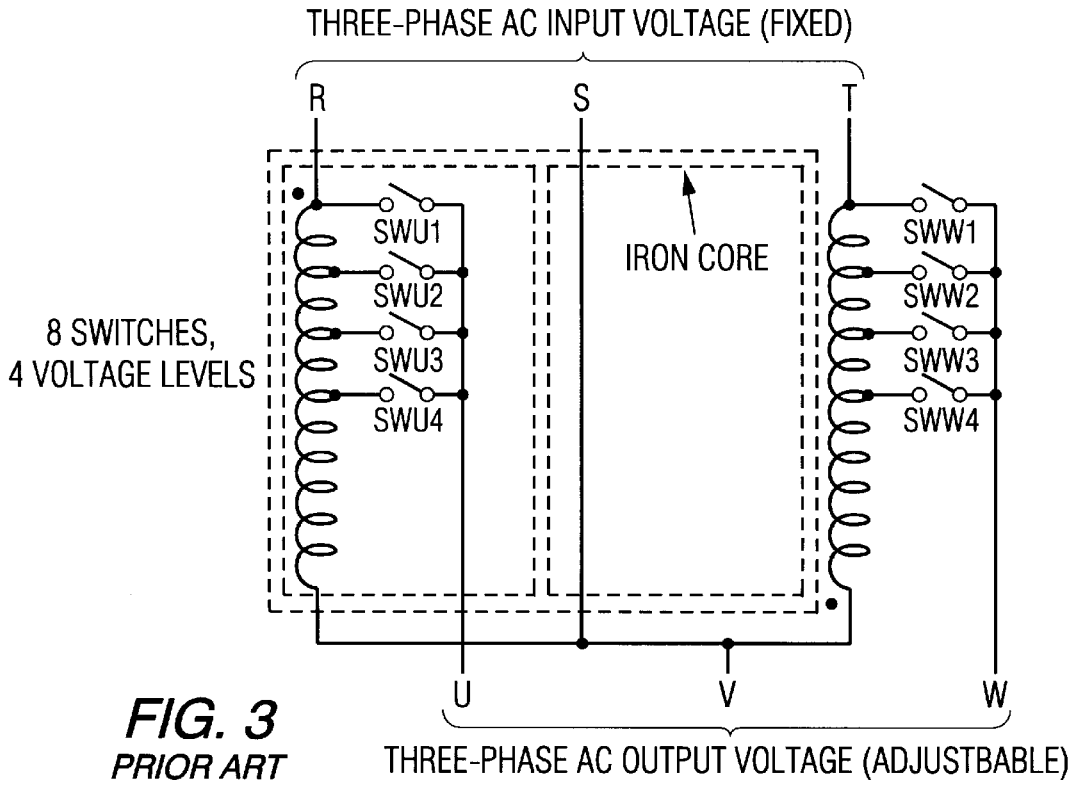
FIG. 3 PRIOR ART
FIG. 3 is a schematic representation of a typical open-delta transformer configuration used in the prior art.
Figure 4:
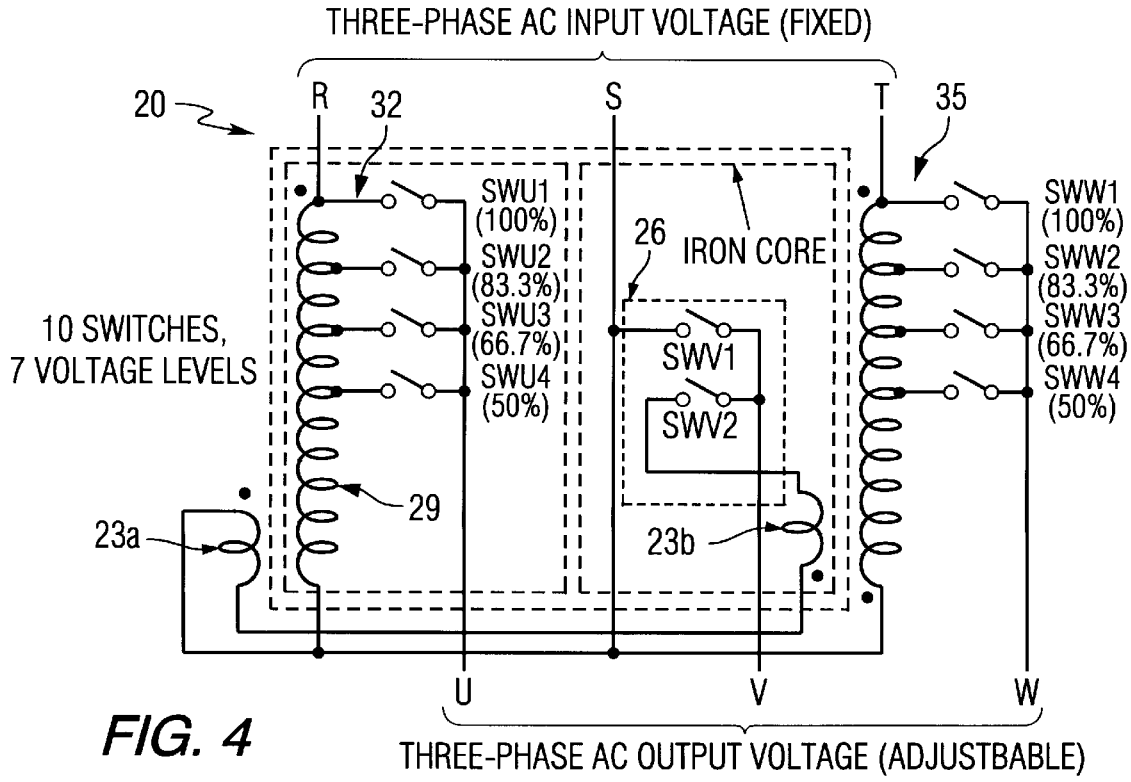
FIG. 4 is a schematic representation of an improved AC tap changer according to the present invention.

Referring now to the drawings in detail, in which the same reference characters refer to similar elements, FIG. 4 shows the improved tap changer approach of the present invention. The open-delta configuration for a transformer 20 as shown in FIG. 3 is retained, but auxiliary windings 23*a* and 23*b,* and associated phase switch means 26 are provided to create another possible connection for output terminal V in addition to the typical output terminals U and W. Also, as is conventional, input terminals R, S and T are provided. FIG. 4 shows one way to connect the auxiliary windings, but other ways are possible as will be explained. Two additional switches SWV1 and SWV2 are arranged to allow output terminal V to be connected either to input terminal S (SWV1) or to the auxiliary windings 23 (SWV2) for balancing the output voltage on each of the output terminals U, V, W and ensuring that they are 120° out of phase.

Figure 2:
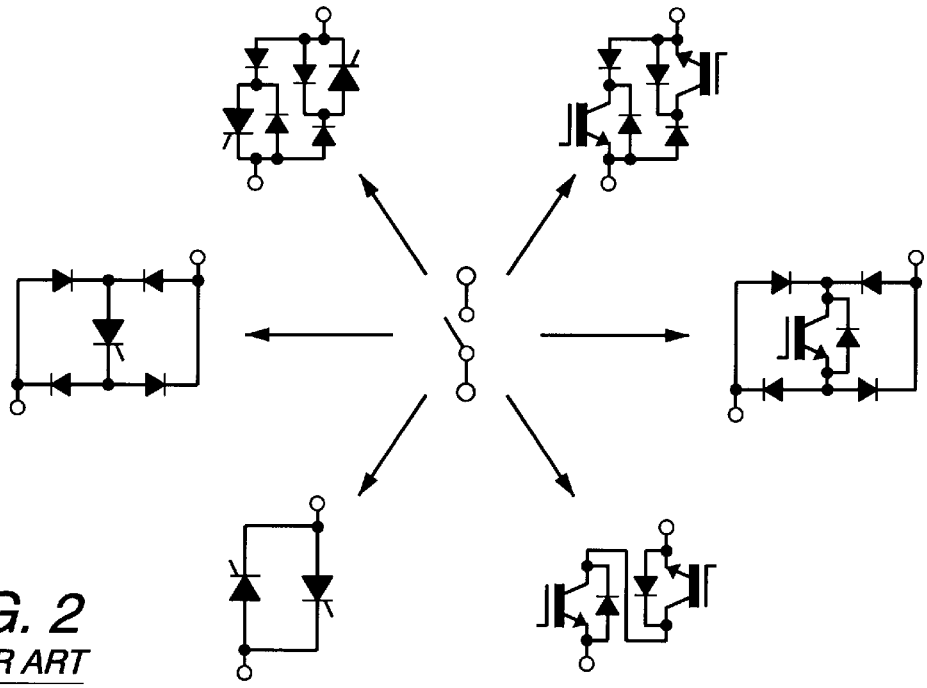
FIG. 2 PRIOR ART
FIG. 2 is a schematic representation of various ways of implementing an AC switch.

The tap changer approach of FIG. 4 requires two more switches than prior art FIG. 2, but it provides seven distinct levels of output voltage instead of four. It has an effect similar to providing new intermediate taps between each adjacent pair of original taps. If these new intermediate taps were actually provided, six new switches (or a total of 14) would be required to connect them. The approach of FIG. 4 achieves the same result with only two new switches (for a total of 10). As used herein, the terms "switch" and "tap" can be used interchangably.

The approach of FIG. 4 can easily be extended to different numbers of taps. The only constraint is that the spacing (voltage magnitude) or number of turns between the taps must be generally uniform. Regardless of the number of taps on the two phases 32, 35 with full windings, only one auxiliary winding 23 and two switches SWV1, SWV2 are required for the third phase (output terminal V in FIG. 4). Some other embodiments may use other configurations of auxiliary winding to achieve the same result.

The following table compares the number of switches needed to achieve different numbers of output voltage levels for these three approaches. The new tap changer approach of the present invention is designated "Open-Delta with Auxiliary Winding" and is set forth in column 4.

| Desired No. of Levels | Conventional Star-Connected | Conventional Open-Delta | Open-Delta with Auxiliary Winding |
|---|---|---|---|
| 3 | 9 switches | 6 switches | 6 switches |
| 4 | 12 switches | 8 switches | 7 switches |
| 5 | 15 switches | 10 switches | 8 switches |
| 6 | 18 switches | 12 switches | 9 switches |
| 7 | 21 switches | 14 switches | 10 switches |

-continued

| Desired No. of Levels | Conventional Star-Connected | Conventional Open-Delta | Open-Delta with Auxiliary Winding |
|---|---|---|---|
| 8 | 24 switches | 16 switches | 11 switches |
| 9 | 27 switches | 18 switches | 12 switches |
| 10 | 30 switches | 20 switches | 13 switches |
| 11 | 33 switches | 22 switches | 14 switches |
| 12 | 36 switches | 24 switches | 15 switches |
| 13 | 39 switches | 26 switches | 16 switches |

Figure 5A:
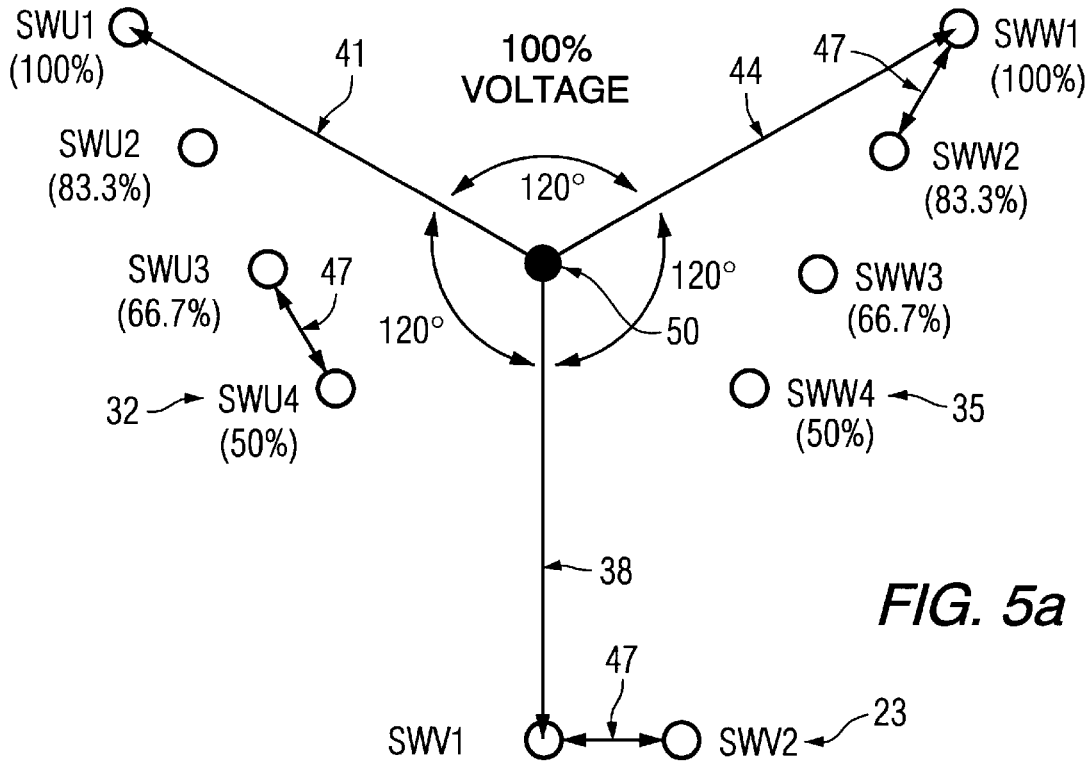
FIG. 5, consisting of FIGS. 5*a*–5*g,* are phase diagrams of the output voltage provided by closing a particular switch of the transformer shown in FIG. 4.

The way in which the circuit of FIG. 4 provides seven output levels with only four taps is illustrated in FIGS. 5*a* through 5*g*. In these figures the tap voltages available at each switch are depicted by the well-known vectors in phase space. The tip of each tap vector is indicated by a circle, but the shaft of the tap vectors are omitted for clarity. Each circle is labeled with the name of the switch to which it connects. The tap voltages of FIGS. 5*a* through 5*g* are at 100%, 83.3%, 66.7%, and 50% of the winding, respectively. In FIG. 5*a,* for example, switches SWU1, SWW1 and SWV1 are closed, whereas in FIG. 5*b,* switches SWU2, SWW1 and SWV2 are closed.

Note that the auxiliary windings 23 in FIGS. 5*a* through 5*g* create a vector for terminal SWV2 which does not lie on the same triangle as the other tap vectors corresponding to phase windings 32 and 35, but instead is displaced horizontally from terminal SWV1 by an amount 47 equal to the spacing (voltage) between taps, which is indicative of the number of turns in the windings between taps.

The location of the neutral point of the load is shown in FIGS. 5*a* through 5*g* by a solid circle 50, and the three line-to-neutral output vectors 38, 41 and 44 are also shown. Note that these lines are of equal length (voltage) and are 120° out of phase with respect to each other. In FIG. 5*a* the output voltage is equal to 100% of the input voltage, which is achieved by closing switches SWU1, SWV1, and SWW1. The output vectors are clearly balanced, which is expected since the output is equal to the input which is balanced.

Figure 1:
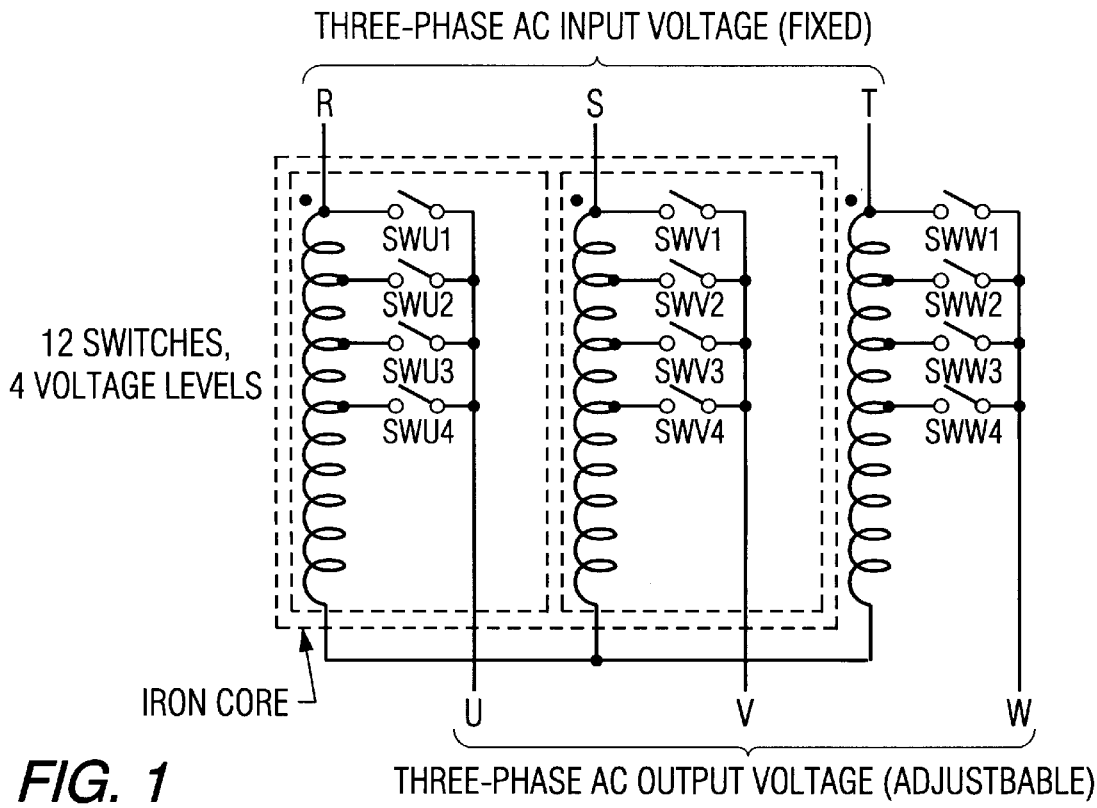
FIG. 1 PRIOR ART
FIG. 1 shows a prior art transformer switching scheme typically used for a reduced-voltage AC induction motor starter.
Figure 5B:
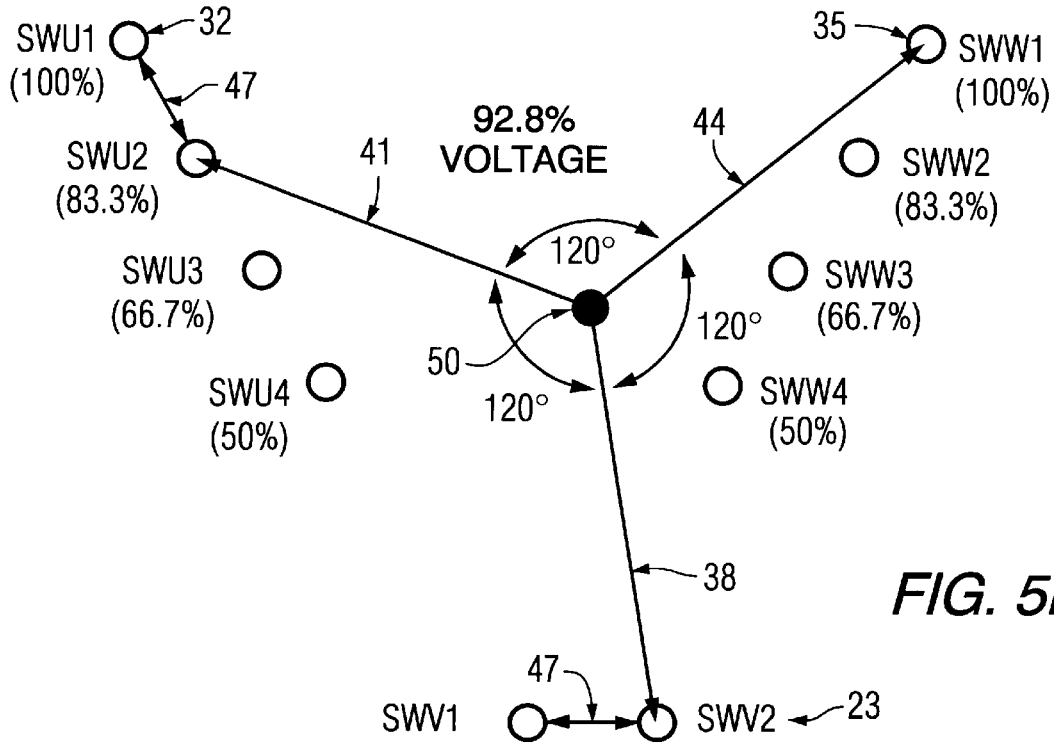

In FIG. 5*b* the output terminal U has been reduced to 83.3% by closing SWU2 instead of SWU1, but output terminal W remains at 100% (SWW1 closed). This non-matching connection of phases was not allowed in FIGS. 1 and 3, because it would produce unbalanced output voltage. However, in FIG. 5*b* the output balance is maintained by connecting output terminal V to the auxiliary windings 23 via SWV2. The amplitude of the output voltage is 92.8%, approximately midway between 100% and 83.3%. Note that the neutral point 50 has also shifted (down and to the right, as represented in the figures).

Figure 5C:
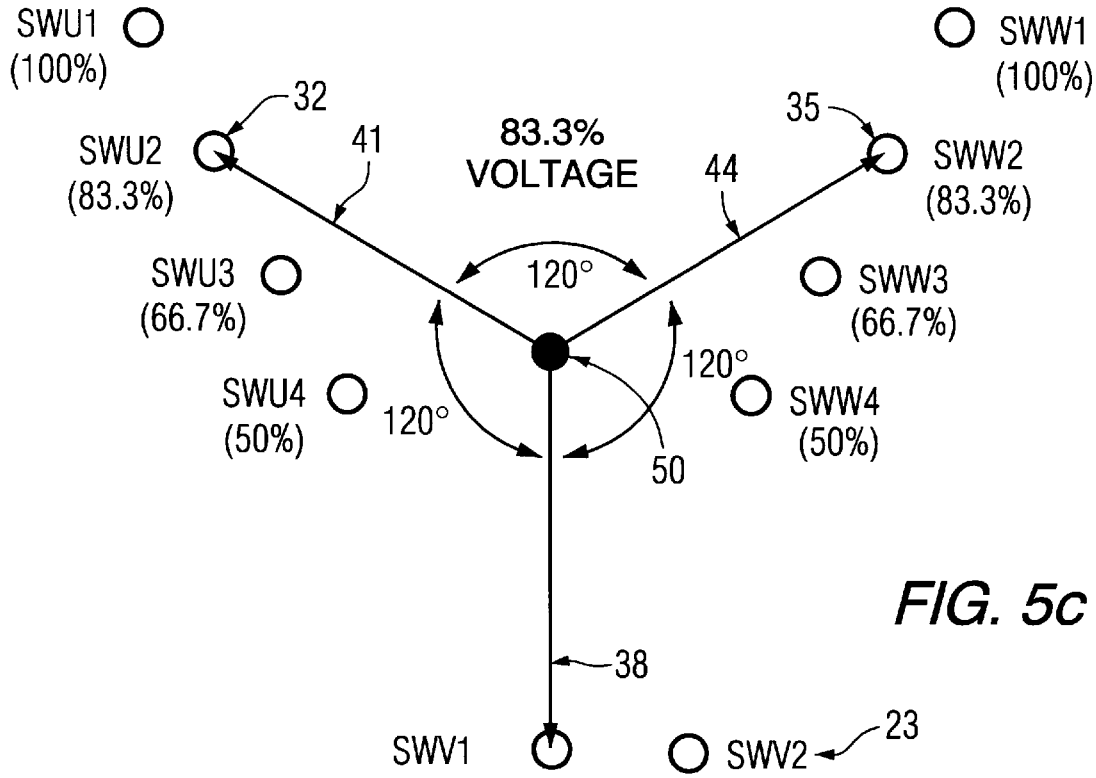

In FIG. 5*c* the output voltage is equal to 83.3% of the input voltage, which is achieved by closing switches SWU2, SWV1, and SWW2. The output vectors 38, 41 and 44 are clearly balanced, which is expected since the outputs are connected matching taps in both phases 32, 35 and the auxiliary windings 23 are not used.

Figure 5D:
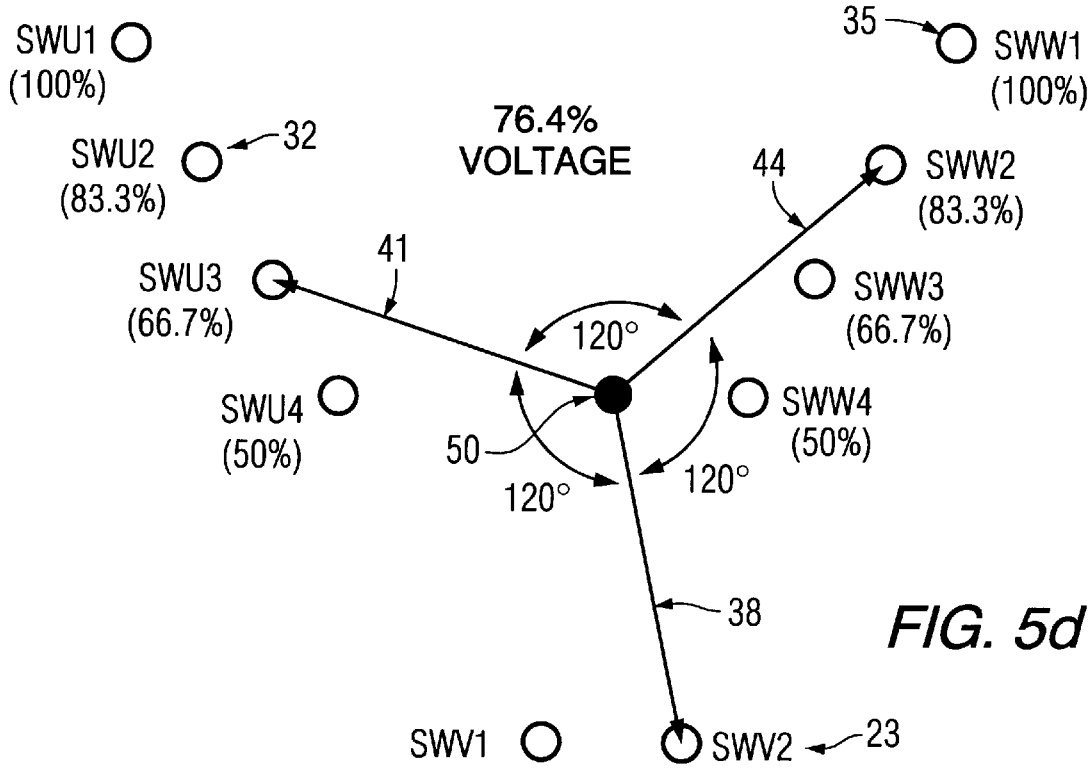

In FIG. 5*d* the output terminal U has been reduced to 66.7% by closing SWU3 instead of SWU2, but output terminal W remains at 83.3% (SWW2 closed). The output balance is maintained by connecting output terminal V to the auxiliary windings via terminal SWV2. The amplitude of the output voltage is 76.4%, approximately midway between 83.3% and 66.7%.

Figure 5E:
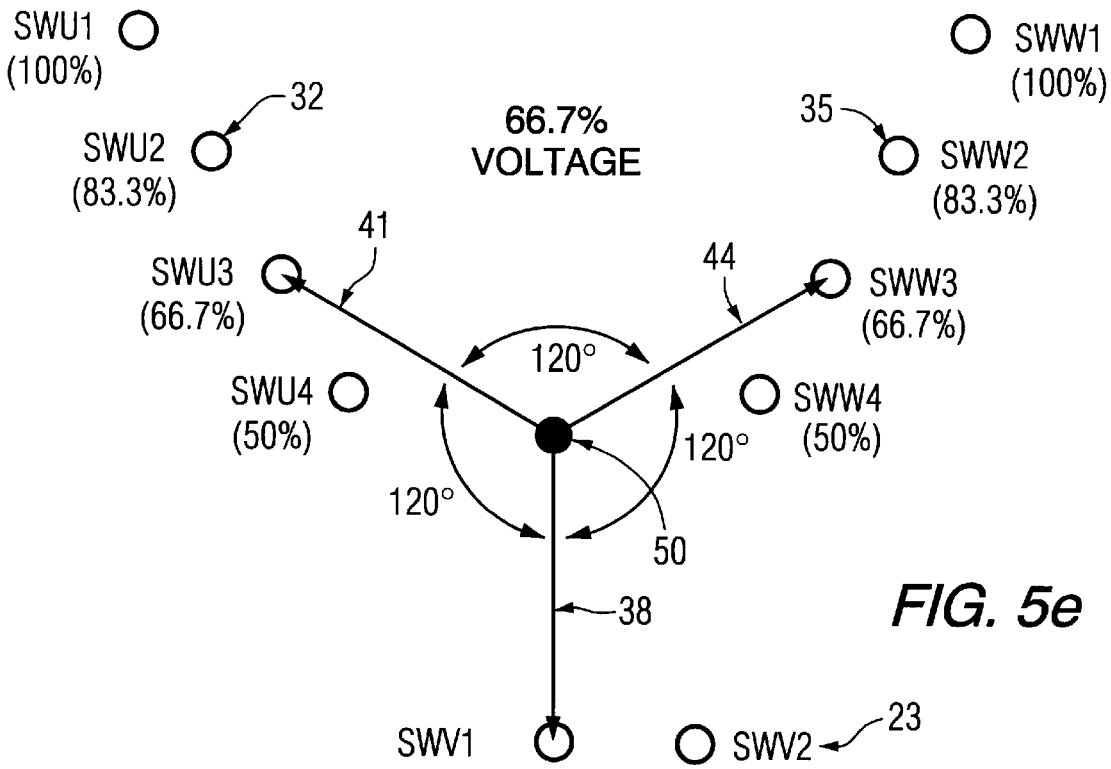

In FIG. 5*e* the output voltage is equal to 66.7% of the input voltage, which is achieved by closing switches SWU3, SWV1, and SWW3. The output vectors are clearly balanced, which is expected since the outputs are connected to matching taps in both phases 32, 35 and the auxiliary windings are not used.

Figure 5F:
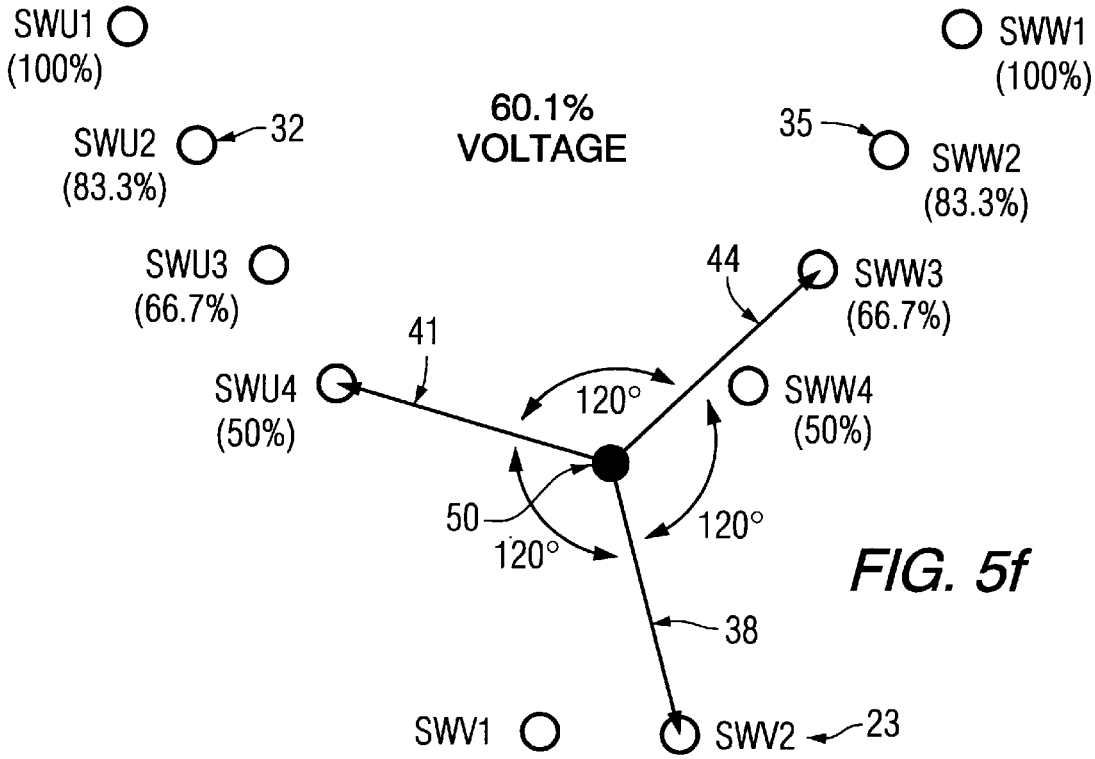

In FIG. 5*f* the output terminal U has been reduced to 50% by closing SWU4 instead of SWU3, but output terminal W remains at 66.7% (SWW3 closed). The output balance is maintained by connecting output terminal V to the auxiliary windings via terminal SWV2. The amplitude of the output voltage is 60.1%, approximately midway between 66.7% and 50%.

Figure 5G:
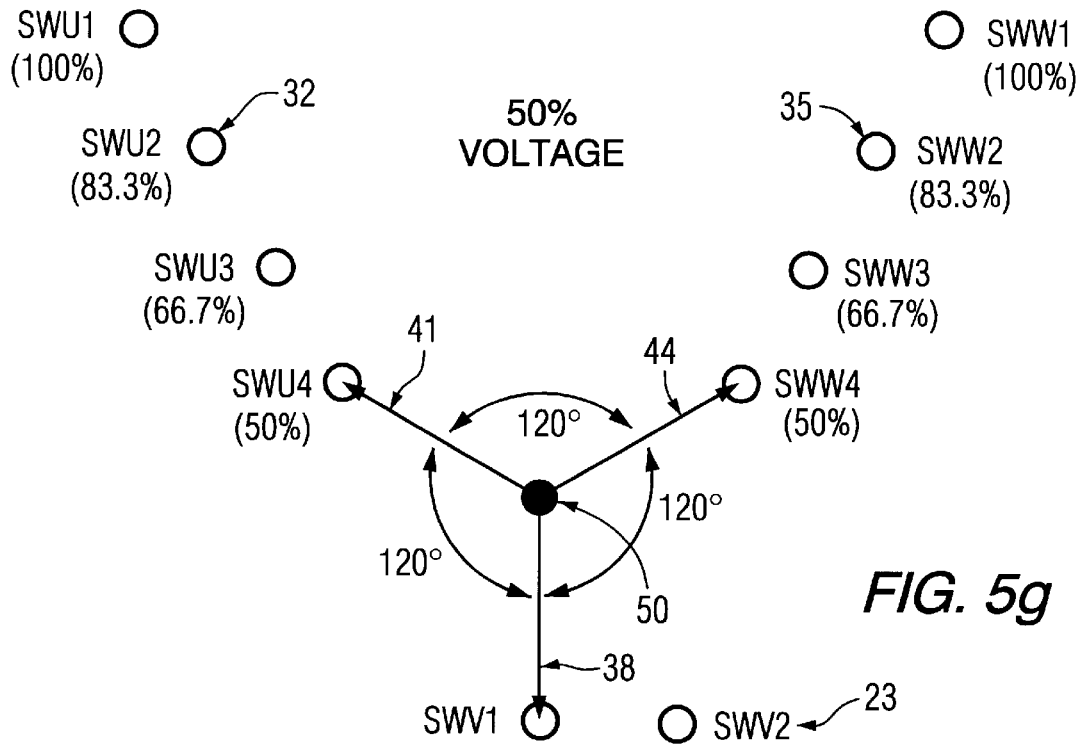

In FIG. 5*g* the output voltage is equal to 50% of the input voltage, which is achieved by closing switches SWU4, SWV1, and SWW4. The output vectors are clearly balanced, which is expected since the outputs are connected to matching taps in both phases 32, 35 and the auxiliary windings are not used.

Note that for an odd number of levels, the two full windings will differ by one in number of taps. That is, one output winding will have an additional tap for use with the auxiliary winding. Thus, the number of switches or taps is always equal to three more than the number of output levels desired. In the examples shown in FIG. 5, each output winding has four taps and two are provided for the auxiliary winding for a total of ten taps or switches, and seven output levels are available. To provide an eighth output level, for example, an additional tap SWU5 may be provided on the left coil for connection with the switch SWW4 and SWV2, for a total of eleven taps.

It is possible to prove mathematically the operation of the open-delta with auxiliary winding approach of the present invention, by using the methods of geometry. One such a proof is presented here.

Figure 6:
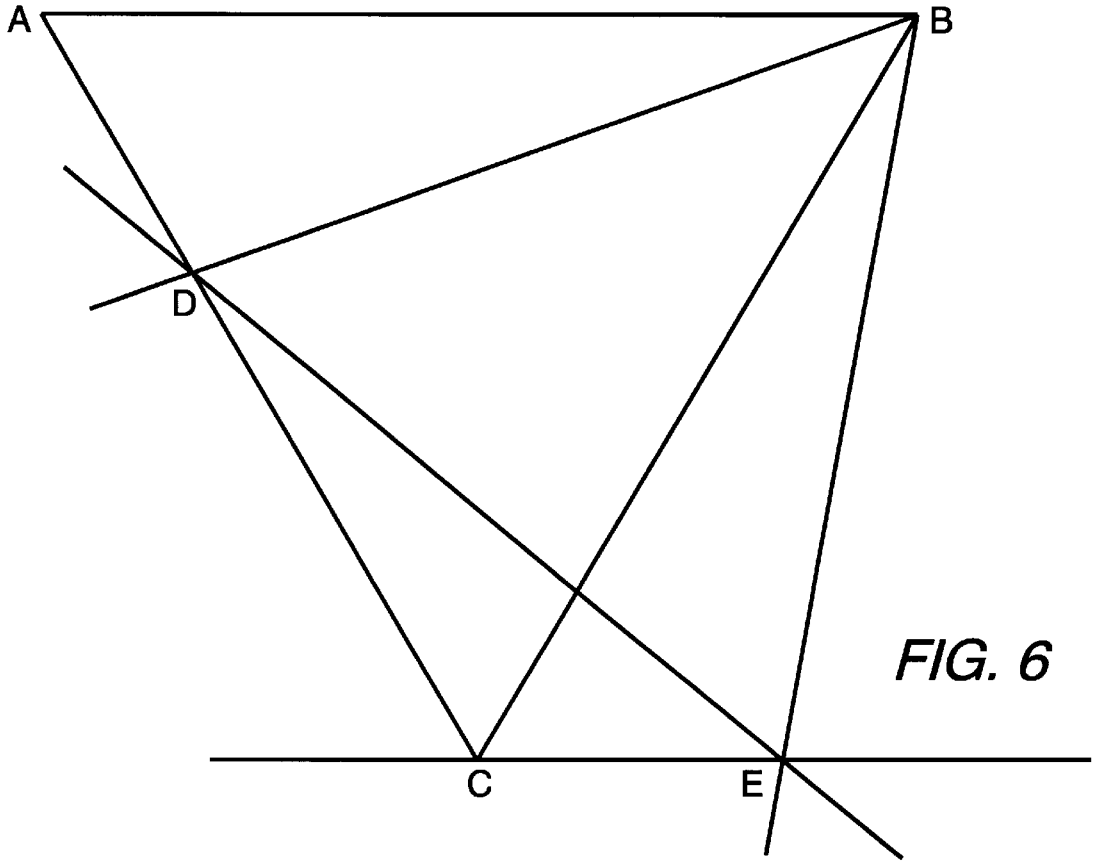
FIGS. 6 and 7 are a geometric representation of the phase diagrams shown in FIG. 5 in providing a mathematical basis for the present invention.

Given any equilateral triangle A-B-C as shown in FIG. 6, choose any point D on side A-C, and construct a new equilateral triangle D-B-E. Construct line C-E through points C and E. Then line C-E will be parallel to line A-B, and the length of line segment C-E will equal the length of line segment A-D.

Proof

1. Side A-B is equal to side C-B by construction.
2. Side D-B is equal to side E-B by construction.
3. Angle A-B-C equals angle D-B-E equals 60° by construction.
4. Angle A-B-D equals (60°—angle D-B-C).
5. Angle C-B-E equals (60°—angle D-B-C) equals angle A-B-D.
6. Triangle A-B-D is congruent with triangle C-B-E by side-angle-side.
7. Therefore the length of side A-D is equal to the length of side C-E, and angle D-A-B is equal to angle E-C-B.
8. But angle C-B-A is equal to angle D-A-B by construction.
9. Therefore angle C-B-A is equal to angle B-C-E.
10. Therefore line A-B is parallel to line C-E by equal intercept angles.

Figure 7:
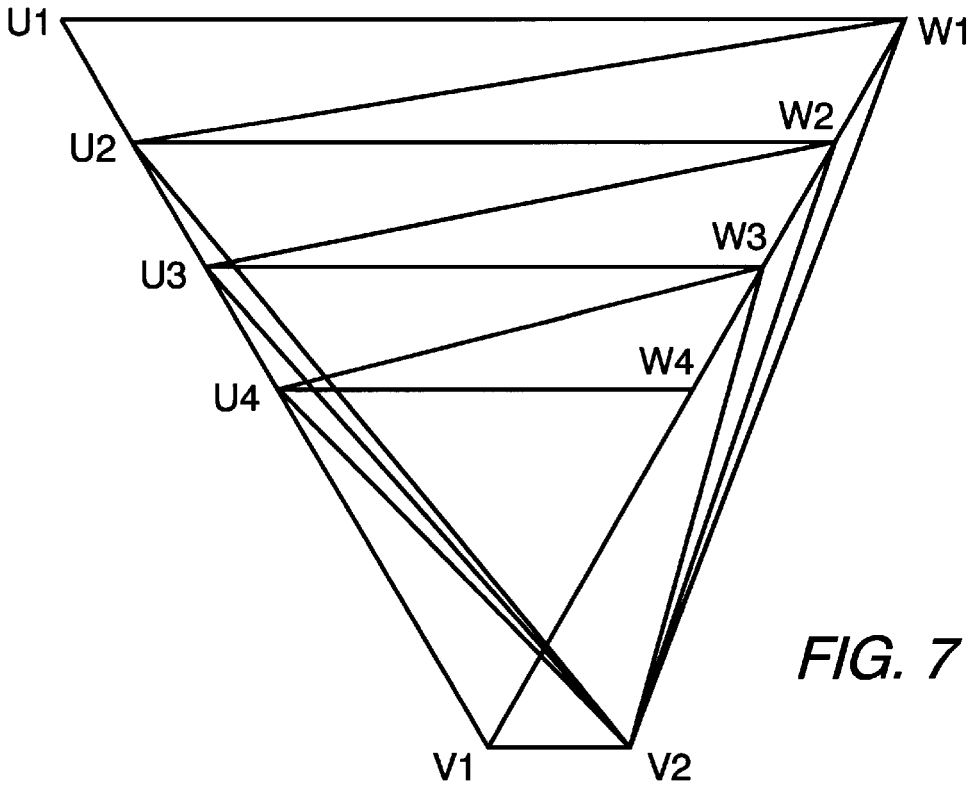

The above can then be used to construct the diagram in FIG. 7.

Start with equilateral triangle U1-W1-V1 (which is representative of switches SWU1, SWW1 and SWV1) and point U2 as shown on side U1-V1. Construct equilateral triangle U2-W1-V2. By the preceding theorem, line segment U1-U2 is equal to line segment V1-V2, and line V1-V2 is parallel to line U1-W1.

Now construct line U2-W2 also parallel to line U1-W1, and locate point U3 on side U2-V1 such that line segment U2-U3 is also equal to line segment U1-U2 or V1-V2. Construct an equilateral triangle on side U3-W2. Then by the preceding theorem the new triangle will also have an apex on point V2. Now construct line U3-W3 also parallel to line U1-W1, and locate point U4 on side U3-V1 such that line segment U3-U4 is also equal to line segment V1-V2. Construct an equilateral triangle on side U4-W3. Then by the preceding theorem the new triangle will also have an apex on point V2.

This process can be continued indefinitely, if the initial choice of line segment U1-U2 is short enough. FIG. 7 shows the case where line segment U1-U2 is one-sixth of line U1-V1, and corresponds to FIGS. 5*a*–5*g*. There are three equilateral triangles of diminishing size which share apex V2 and four which share apex V1 for a total of seven equilateral triangles approximately evenly spaced in size. The smallest triangle is exactly half the size of the largest. These seven triangles are equivalent to the seven output voltages shown in FIGS. 5*a*–5*g*.

FIGS. 8*a*–8*d* show alternate connections to achieve the geometry of FIG. 7. In the following description of these figures, the term "auxiliary winding" is used to imply a secondary winding for an autotransformer, or a tertiary winding for an isolation transformer.

Figure 8A:
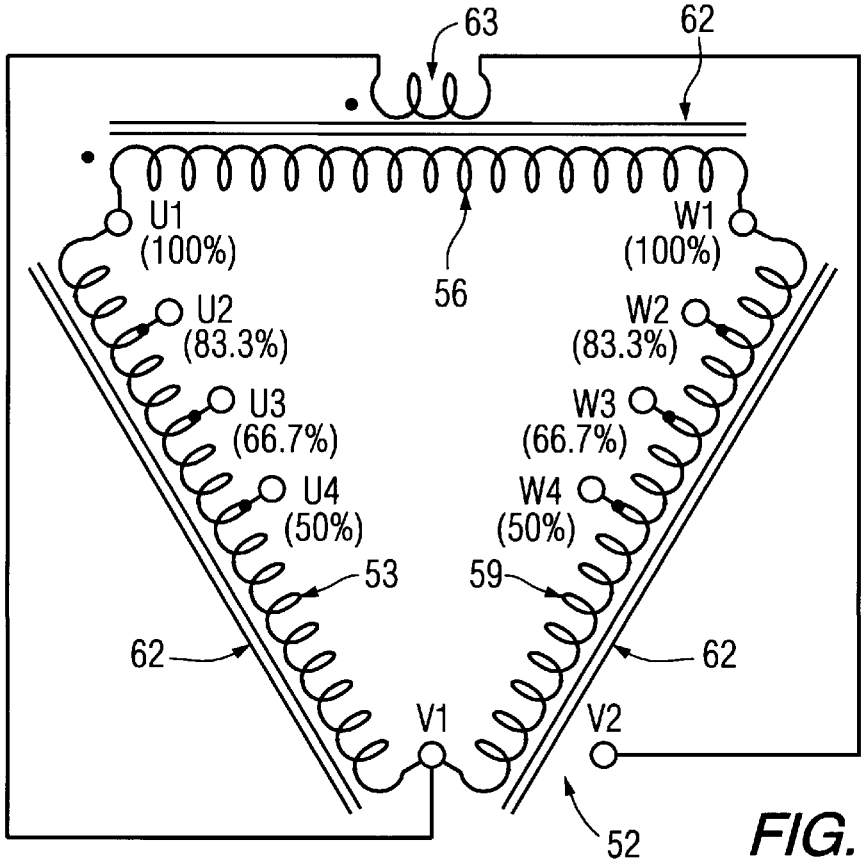
FIG. 8, consisting of FIGS. 8*a*–8*d,* shows examples of various winding geometries which can be used to implement the improved three-phase AC transformer tap changer of the present invention.

FIG. 8*a* shows one way a transformer or autotransformer 52 could be connected to achieve the geometry of FIG. 7 and/or the phase diagrams of FIGS. 5*a*–5*g*. The incoming three-phase AC voltage is connected to points U1, W1, and V1 for the autotransformer case; for an isolation transformer the voltage is induced onto U1, V1, and W1 from the primary (not shown). The three coils 53, 56, 59 are each on one leg of a core constructed from laminated electrical steel, represented symbolically by the double lines 62. The coils 53 (U1-V1) and 59 (W1-V1) have no auxiliary winding, but have 3 taps (U2, U3, U4 and W2, W3, W4, respectively) evenly spaced from one end. The coil 56 (U1-W1) has no taps, but has an auxiliary winding 63 with the same number of turns as exist from U1-U2 or from W1-W2 on the other coils 53 and 59, respectively. The voltage output of this auxiliary winding also has the same phase angle as the voltage from U1-W1, so that when one end is connected to point V1 as shown the other end generates point V2.

Figure 8B:
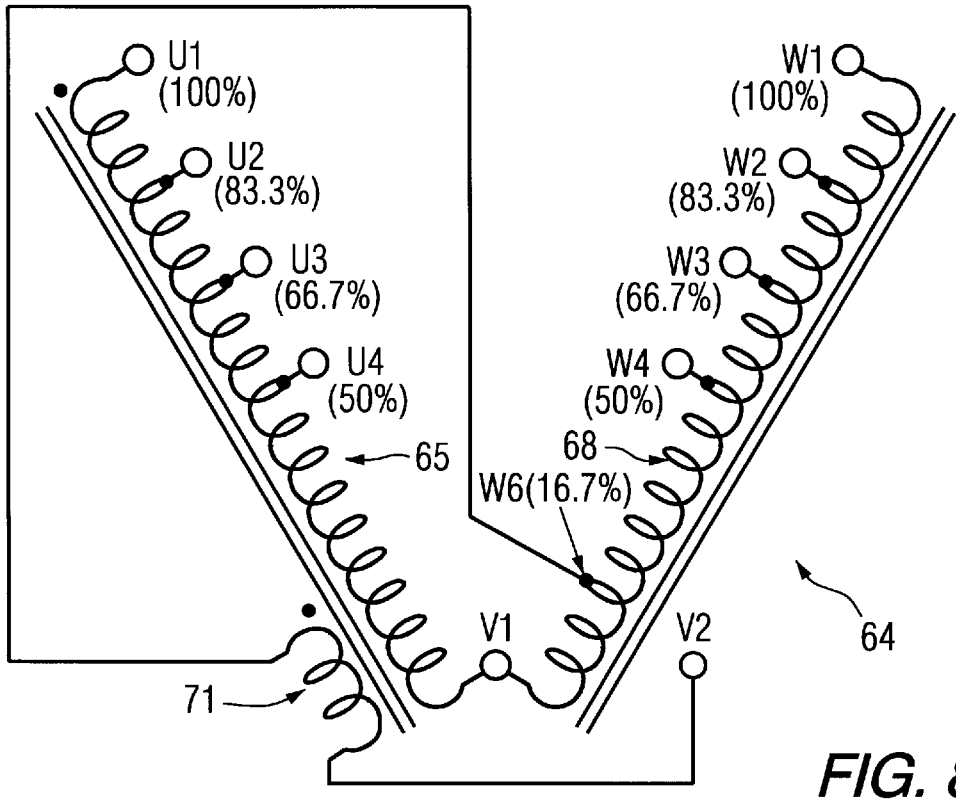

There are other ways a transformer or autotransformer 64 could be connected to achieve the geometry of FIG. 7. One alternate approach is shown in FIG. 8*b*, which has the advantage that only two coils 65, 68 are needed between point U1-V1 and W1-V1, respectively. There must still be three legs to the core, or else two separate cores with independent return paths for magnetic flux. The incoming three-phase AC voltage is again connected to points U1, W1, and V1. The coil 65 (U1-V1) now has an auxiliary winding 71 with the same number of turns as exist from U1-U2 or from W1-W2 (identical to that of FIG. 8*a*), while coil 68 (W1-V1) has an extra tap W6 displaced from the V1 end by the same number of turns. The voltage from W6 to V1 has the same phase angle as the voltage from W1 to V1, while the output of the auxiliary winding 71 has the same phase angle as the voltage from U1 to V1; so that when one end is connected to point W6 as shown the other end generates point V2.

Figure 8C:
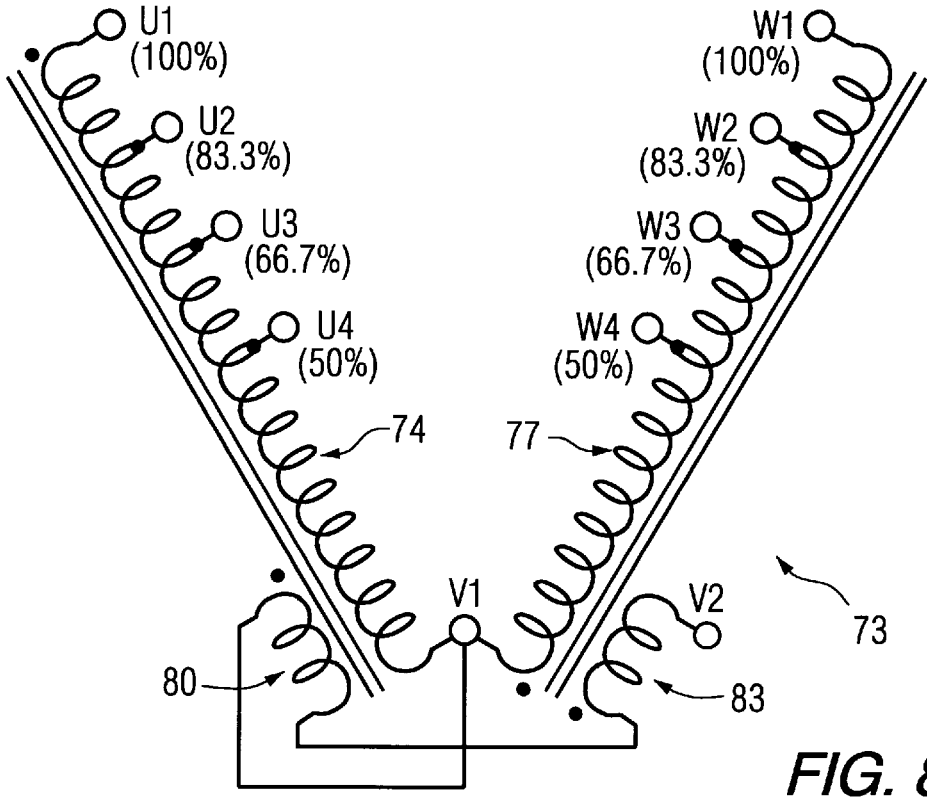

FIG. 8*c* shows a third embodiment for a transformer or autotransformer 73 connected to achieve the geometry of FIG. 7. This alternate approach has the advantages that only two coils 74, 77 are needed, and they are essentially identical. Again, there must still be three legs to the core, or else two separate cores with independent return paths for magnetic flux. The incoming three-phase AC voltage is again connected to points U1, W1, and V1. Both coils U1-V1 and W1-V1 now have a respective auxiliary winding 80, 83 with the same number of turns as exist from U1-U2 or from W1-W2 (identical to that of FIG. 8*a*). The voltage from the left auxiliary 80 has the same phase angle as the voltage from U2 to V1, while the voltage from the right auxiliary 83 has the same phase angle as the voltage from W1 to V1. When the two auxiliary windings are connected in series opposition as shown, the net voltage produced is exactly that required to displace point V2 from point V1.

Figure 8D:
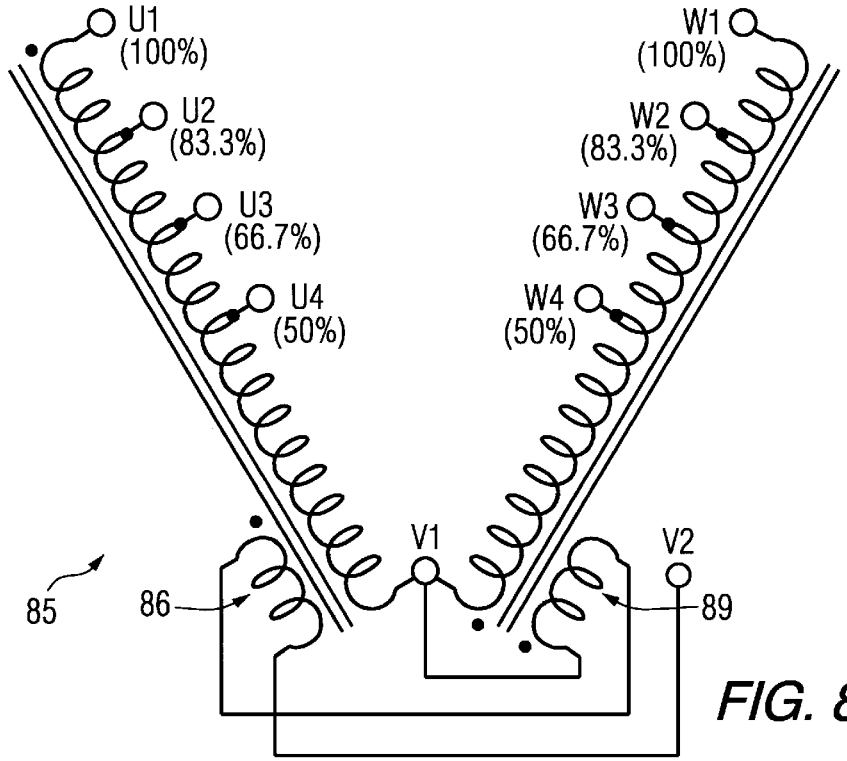

FIG. 8*d* shows a fourth embodiment for a transformer or autotransformer 85 connected to achieve the geometry of FIG. 7. This alternate approach is essentially the same as FIG. 8*c*, but the two series-connected auxiliary windings 86, 89 have been interchanged.

It is also possible to create mirror images of the four circuits in FIGS. 8*a* through 8*d*, so that the auxiliary winding tap V2 lies to the left of V1 instead of to the right. These and other variations for constructing transformers or autotransformers according to the teachings of the present invention would be readily apparent to one skilled in the art.

Figure 9:
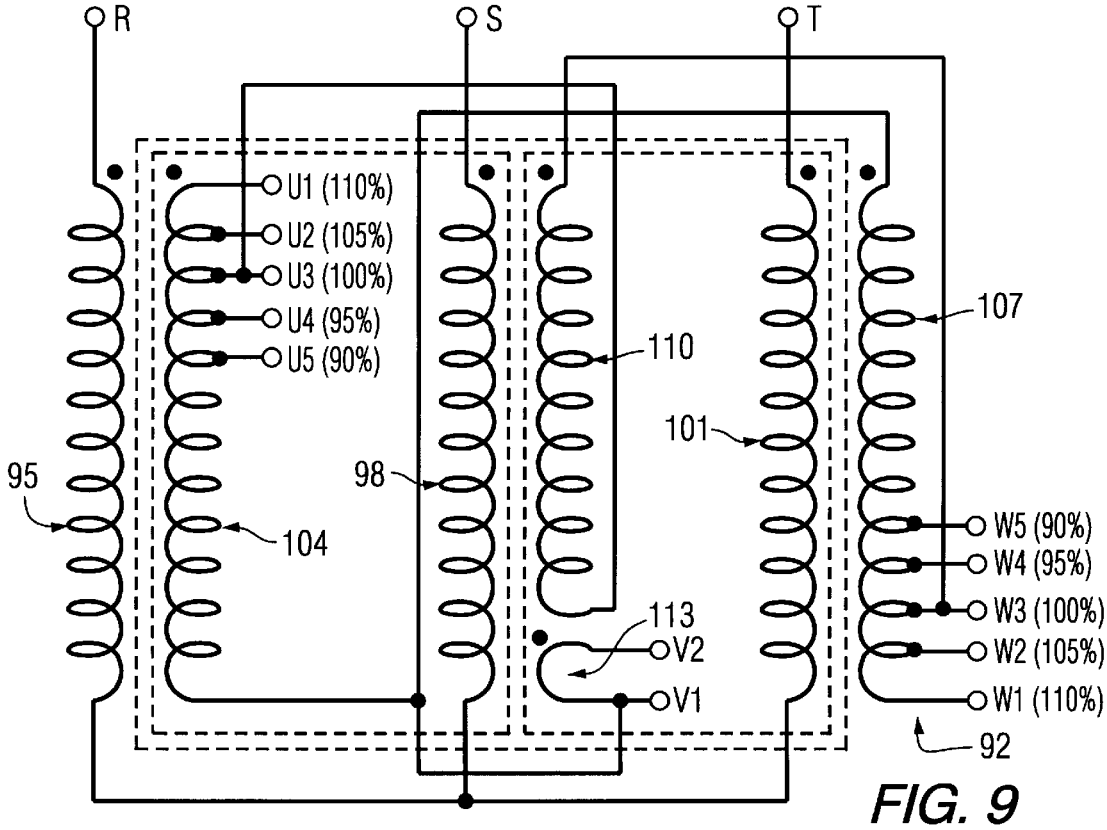
FIG. 9 is a schematic representation of an isolation transformer according to the present invention.

FIG. 9 shows another embodiment of the present invention applied to an isolation transformer, for example, to improve the voltage adjustment capability of a utility distribution transformer. Such transformers are often supplied with secondary taps (U1–U5 and W1–W5) to allow voltage adjustment. Typical tap configurations are for +10%, +5%, nominal, −5%, and −10% voltage. If the transformer is oil-filled, each tap requires a bushing to penetrate the oil tank; therefore it is highly desirable to minimize the number of taps and bushings.

In FIG. 9 the connection scheme of FIG. 8*a* has been adapted to an isolation transformer 92. The primary or voltage input terminals are designated R, S, and T and are connected to primary coils 95, 98 and 101. The left secondary or power output winding 104 is provided with taps U1 at 110% voltage, U2 at 105%, U3 at 100%, U4 at 95%, and U5 at 90% voltage. The right secondary winding 107 is similarly provided with taps W1 at 110% voltage, W2 at 105%, W3 at 100%, W4 at 95%, and W5 at 90% voltage. The center secondary winding 110 has no taps and is shown at 100% voltage. The three secondary windings are delta connected using the 100% taps U3, W3. The delta connection can be made at any tap level, as long as the center secondary voltage corresponds to the chosen taps.

The center coil also contains an auxiliary winding 113 to match the tap spacing of 5%. This is connected as in FIG. 8*a* to displace terminal V2 horizontally from terminal V1.

The configuration of FIG. 9 provides the following possible balanced output voltage levels, when the load is connected to the taps as listed:

| Percent Voltage | Load Connection |
|---|---|
| 110 | U1-V1-W1 |
| 107.6 | U2-V2-W1 |
| 105 | U2-V1-W2 |
| 102.6 | U3-V2-W2 |
| 100 | U3-V1-W3 |
| 97.6 | U4-V2-W3 |
| 95 | U4-V1-W4 |
| 92.6 | U5-V2-W4 |
| 90 | U5-V1-W5 |

These nine levels are provided with only twelve secondary bushings or load-connection points. If the auxiliary winding method was not used, eighteen bushings would be needed for open-delta, or twenty-seven bushings for a star-connected transformer constructed according to conventional methods. It will be understood by those skilled in the art that phase rotations or mirror image variations of FIG. 9 are considered equivalent.

While the embodiments described in the previous invention have been discussed as a variable output voltage transformer, it can be seen that utilizing switches, either solid state or mechanical, the transformer can be used as a motor starter. The addition of solid state switching permits the adjustable voltage output transformer to deliver three-phase balanced reduced voltage starting to a motor. The output voltage can be varied to provide an increasing starting voltage over time, while receiving a constant input voltage from a voltage source. In other applications, the transformer with the appropriate taps may be utilized to practice the invention to provide a variety of voltages to an output. The taps may be merely bolt on taps, which are adjusted manually for a specific desired voltage, and then remain so connected during continuous use.

While specific embodiments of the invention have been described in detail, it will be appreciated by those skilled in the art that various modifications and alterations would be developed in light of the overall teachings of the disclosure. Accordingly, the particular arrangements disclosed are meant to be illustrative only and not limiting as to the scope of the invention which is to be given the full breadth of the appended claims and in any and all equivalents thereof.

What is claimed is:

1. A three-phase transformer comprising:

(a) at least two output windings;

(b) at least a pair of said output windings each of said pair having at least one tap, each of said taps being generally equally spaced for generally equal tap voltages;

(c) at least one auxiliary winding connected to at least one of said output windings; and (d) said auxiliary winding providing an auxiliary output voltage so that the voltage from a junction point of said pair of output windings to said auxiliary winding generally equals the magnitude of the voltage between respective ones of said taps.

2. The three-phase transformer of claim 1, wherein said at least two output windings comprises a first output winding having a first predetermined number of turns and a second output winding having a second predetermined number of turns, each of said first and second output windings having at least two generally equally spaced taps such that the three-phase transformer has at least two output voltages.

3. The three-phase transformer of claim 2, wherein said auxiliary winding has a third predetermined number of turns, said auxiliary winding having two auxiliary winding terminals, said auxiliary winding terminals being spaced apart generally equal to the spacing between said taps on said first and second output windings, wherein said taps of said first and second output windings are alternatively connectable with said auxiliary such that the three-way transformer has at least three output voltages.

4. The three-phase transformer of claim 2, wherein said auxiliary winding has a third predetermined number of turns and two auxiliary winding terminals, said auxiliary winding terminals being spaced apart generally equal to the spacing between said taps on said first and second output windings, said first and second output windings having an equal number of taps such that the three-phase transformer has a number of output voltages equal to one less then the total number of taps on said first and second output windings.

5. The three-phase transformer of claim 4, wherein said first output winding has an additional tap.

6. The three-phase transformer of claim 1, wherein the transformer is an isolation transformer with separate primary or input windings.

7. The three-phase transformer of claim 1, wherein said at least two output windings comprises a first output winding, a second output winding and a third output winding, the auxiliary winding having a phase generally equal to the phase of the voltage of the third output winding disposed between the ends of said output windings opposite said junction point.

8. The three-phase transformer of claim 1, wherein said at least two output windings comprises a first output winding and a second output winding, said second output winding having one additional tap more than said first output winding, said auxiliary winding being connected to said second output winding and having a phase generally equal to the phase of the voltage of said first output winding.

9. The three-phase transformer of claim 1, wherein said at least two output windings comprises a first output winding and a second output winding, and said at least one auxiliary winding comprises a first auxiliary winding, said first output winding and second auxiliary winding having a phase generally equal to said second output winding.

10. A three-phase transformer having a primary winding and a secondary winding, the secondary winding comprising:

a first phase secondary winding having a first predetermined number of turns;

a second phase secondary winding having a second predetermined number of turns;

at least two switching means provided on each of said first and second phase secondary windings, there being a first preselected number of turns between said switching means; and an auxiliary switching means operably connected with said first and second phase secondary windings and having an auxiliary winding to provide an output voltage, said auxiliary winding having a second preselected number of turns equal to the first preselected number of turns between said switching means, wherein the auxiliary switching means is operable between a first position which bypasses the auxiliary winding and a second position which incorporates the auxiliary winding.

11. In a transformer having a primary winding coupled to a source of electrical power and means for connecting a voltage output to an electrical load, said connecting means comprising:

a first secondary winding operatively coupled to the primary winding, the first secondary winding having a first plurality of turns and at least two output voltage taps connected to said first secondary winding and spaced thereon a predetermined number of turns such that the first secondary winding has at least a first output voltage level and a second output voltage level;

first switch means for switching between said voltage output taps;

a second secondary winding operatively associated with the primary winding, the second secondary winding having a second plurality of turns and at least one output voltage tap connected to said second secondary winding such that the second secondary winding has at least a third output voltage level, wherein said first and third output voltage levels are substantially equal; and an auxiliary winding having a third predetermined number of turns and a second switch means operably between a first switch position and a second switch position wherein a phase angle of the voltage output is adjusted such that the voltage output level is varied.

* * * * *